US011510295B1

(12) United States Patent
Chen

(10) Patent No.: US 11,510,295 B1
(45) Date of Patent: Nov. 22, 2022

(54) COLOR TEMPERATURE CONTROL DEVICE FOR LED LAMP

(71) Applicant: AIR COOL INDUSTRIAL CO., LTD., Taichung (TW)

(72) Inventor: Shih-Ming Chen, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 17/542,659

(22) Filed: Dec. 6, 2021

(51) Int. Cl.
*H05B 45/20* (2020.01)
*H05B 45/325* (2020.01)
*H05B 45/10* (2020.01)

(52) U.S. Cl.
CPC ..... *H05B 45/20* (2020.01); *H05B 45/10* (2020.01); *H05B 45/325* (2020.01)

(58) Field of Classification Search
CPC ..... H05B 45/20; H05B 45/10; H05B 45/325
See application file for complete search history.

(56) References Cited

U.S. PATENT DOCUMENTS

2016/0374177 A1* 12/2016 Chen ..... G06F 3/04883
2019/0141812 A1* 5/2019 Chen ..... H05B 45/20
2020/0100341 A1* 3/2020 Janik ..... H05B 45/20

* cited by examiner

*Primary Examiner* — Minh D A
(74) *Attorney, Agent, or Firm* — Pai Patent & Trademark Law Firm; Chao-Chang David Pai

(57) ABSTRACT

A color temperature control device for an LED lamp is disclosed. The color temperature control device is electrically connected to a lamp and comprises a power supply and a power control circuit. The processor can output a color temperature change processing signal. The power control circuit can control the lamp to change the color temperature in a full-on state according to the full-on state of the lamp and a color temperature change processing signal. The power control circuit can control the lamp to change the color temperature in a dimming state according to the dimming state of the lamp and a color temperature change processing signal. Thereby, the color temperature of the lamp can be changed in the full-on state of the lamp or in the dimming state of the lamp, thereby increasing the convenience of use.

7 Claims, 6 Drawing Sheets

COLOR TEMPERATURE CONTROL DEVICE FOR LED LAMP

FIELD OF THE INVENTION

The present invention relates to an LED lamp, and more particularly to a color temperature control device for an LED lamp.

BACKGROUND OF THE INVENTION

A light-emitting diode has the characteristics of high durability, long service life, small size, low power consumption, etc., used as an extremely ideal new-generation lighting source. Especially, in the current situation of rising energy costs, light-emitting diodes are more valued and used by the industry to replace other conventional light-emitting elements that consume more power. In general, light-emitting diodes are used in lighting devices.

However, most of the existing LED lighting devices only output a light source with a single color temperature. The color temperature of this light source depends on the light-emitting diode installed on the lighting device. Therefore, if the user wants to change the color temperature of the light source, it is necessary to replace the light-emitting diode. In use, the LED lighting device cannot be switched at any time for providing light sources with different color temperatures. It is inconvenient to use. Accordingly, the inventor of the present invention has devoted himself based on his many years of practical experiences to solve these problems.

SUMMARY OF THE INVENTION

The primary object of the present invention is to provide a color temperature control device for an LED lamp, which can change the color temperature in a full-on state or in a dimming state of the lamp, thereby increasing the convenience of use.

In order to achieve the aforesaid object, the present invention provides a color temperature control device for an LED lamp, electrically connected to a lamp and a mains electricity source. The mains electricity source outputs an AC power source. The lamp is an LED lamp. The lamp includes a driver. The color temperature control device comprises a power supply, at least one operating device, a processor, and a power control circuit. The power supply is electrically connected to the mains electricity source. The power supply is configured to output a DC power source. The operating device is controlled to output a lamp full-on operation signal and a color temperature change operation signal. The operating device is one of a wireless remote control receiver, a wall-mounted switch and a hand-pulling switch. The processor is an MCU processor. The processor is electrically connected to the power supply to receive the DC power source for operation of the processor. The processor is electrically connected to the operating device. The processor receives the lamp full-on operation signal to output a lamp full-on processing signal. The processor receives the color temperature change operation signal to output a color temperature change processing signal. The power control circuit is electrically connected to the processor and the mains electricity source. The power control circuit outputs a lamp full-on control signal to the driver according to the received AC power source and the lamp full-on processing signal for controlling the lamp to be in a full-on state. A voltage-time waveform of the lamp full-on control signal is periodic sine waves composed of multiple cycles of sine waves. The power control circuit outputs a lamp full-on color temperature change control signal to the driver according to the full-on state of the lamp and the color temperature change processing signal for controlling the lamp to change its color temperature in the full-on state. A voltage-time waveform of the lamp full-on color temperature change control signal is composed of a plurality of spaced first positive half cycles or a plurality of spaced first negative half cycles. Each first positive half cycle is a positive half cycle of the sine wave. Each first negative half cycle is a negative half cycle of the sine wave.

In the color temperature control device of the LED lamp provided by the present invention, the power control circuit can output the lamp full-on color temperature change control signal to the driver according to the full-on state of the lamp and the color temperature change processing signal for controlling the lamp to change the color temperature in the full-on state. The power control circuit can output the lamp dimming color temperature change control signal to the driver according to the dimming state of the lamp and the color temperature change processing signal for controlling the lamp to change the color temperature in the dimming state. Thereby, the color temperature of the lamp can be changed in the full-on state of the lamp or in the dimming state of the lamp, thereby increasing the convenience of use.

DETAILED DESCRIPTION OF THE PREFERRED EMBODIMENTS

Embodiments of the present invention will now be described, by way of example only, with reference to the accompanying drawings.

Figure 1:
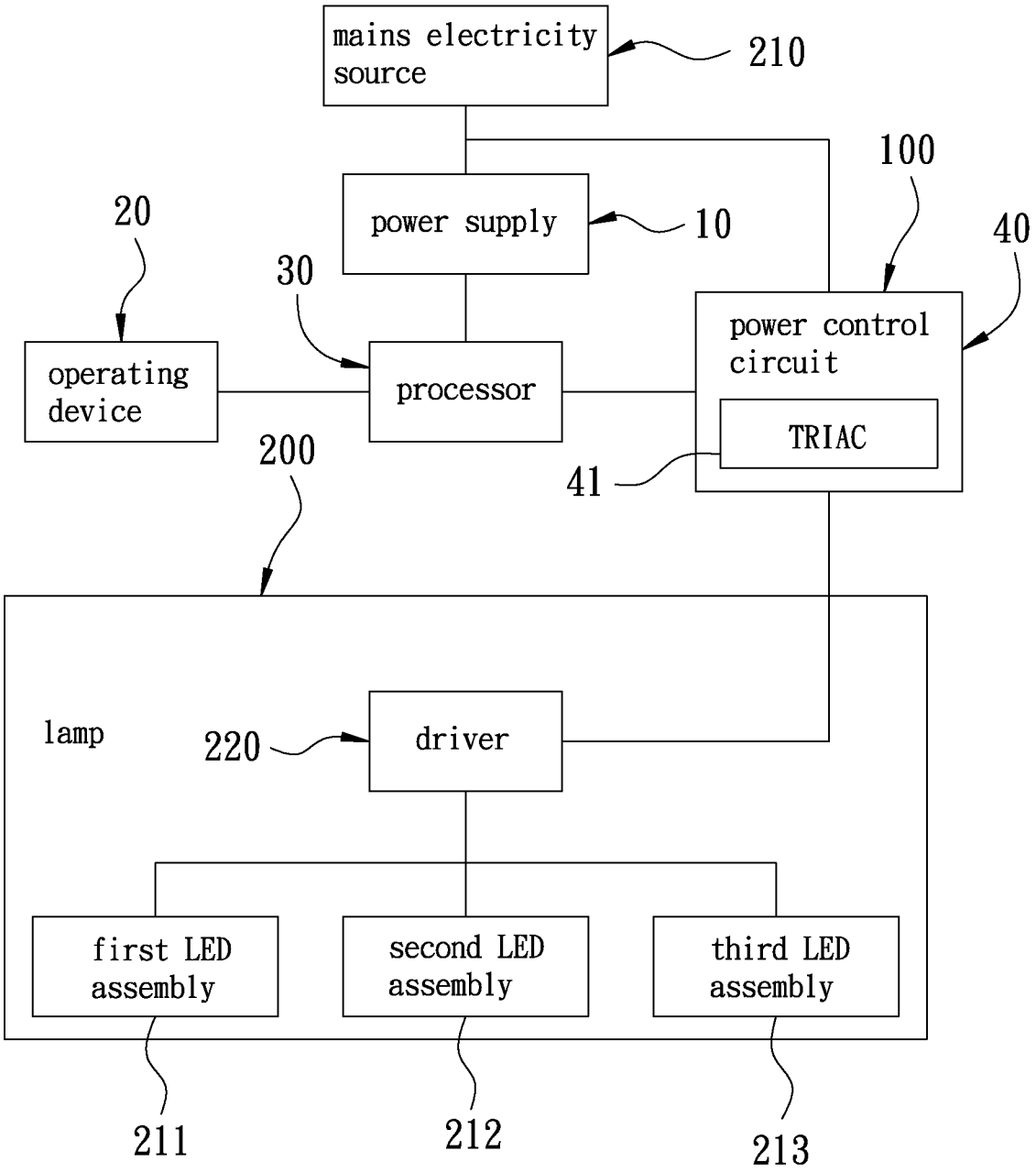
FIG. 1 is a block diagram showing the assembly of a preferred embodiment of the present invention.
Figure 2:
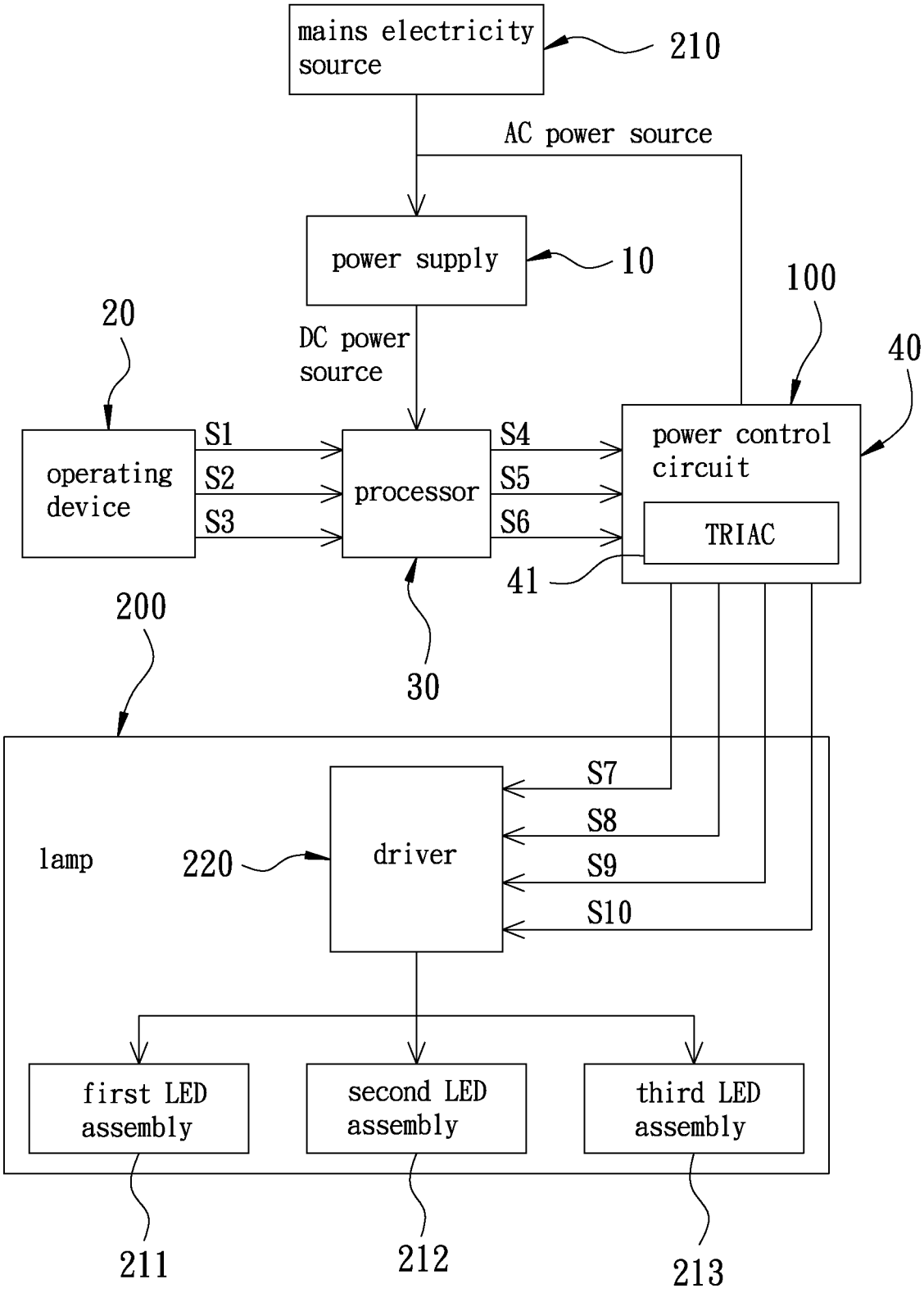
FIG. 2 is a block diagram showing the signals of the preferred embodiment of the present invention.

FIG. 1 is a block diagram showing the assembly of a preferred embodiment of the present invention. FIG. 2 is a block diagram showing the signals of the preferred embodiment of the present invention. The present invention discloses a color temperature control device 100 for an LED lamp. The color temperature control device 100 is electrically connected to a lamp 200 and a mains electricity source 210. The mains electricity source 210 outputs an AC power source. The lamp 200 is an LED lamp. The lamp 200 has a plurality of LED assemblies. The LED assemblies have different color temperatures. The LED assemblies each have a plurality of LED light-emitting members. In the embodiment of the present invention, the lamp 200 further has three LED assemblies, defined as a first LED assembly 211, a second LED assembly 212, and a third LED assembly 213. The first LED assembly 211 is a 5000K color temperature LED lamp. The second LED assembly 212 is a 3000K color temperature LED lamp. The third LED assembly 213 is a 4000K color temperature LED lamp. The lamp 200 includes a driver 220. The driver 220 controls the LED assemblies to be turned on/off for changing the color temperature of the lamp 200. The color temperature control device 100 a power supply 10, at least one operating device 20, a processor 30, and a power control circuit 40.

The power supply 10 is electrically connected to the mains electricity source 210. The power supply 10 is configured to output a DC power source.

The operating device 20 is controlled to output a lamp full-on operation signal S1, a lamp dimming operation signal S2, and a color temperature change operation signal S3. The operating device 20 may be one of a wireless remote control receiver, a wall-mounted switch and a hand-pulling switch.

The processor 30 is an MCU processor. The processor 30 is electrically connected to the power supply 10 to receive the DC power source for operation of the processor 30. The processor 30 is electrically connected to the operating device 20, so that the processor 30 can receive the lamp full-on operation signal 51 to output a lamp full-on processing signal S4. The processor 30 can receive the lamp dimming operation signal S2 to output a lamp dimming processing signal S5. The processor 30 can receive the color temperature change operation signal S3 to output a color temperature change processing signal S6.

Figure 3:
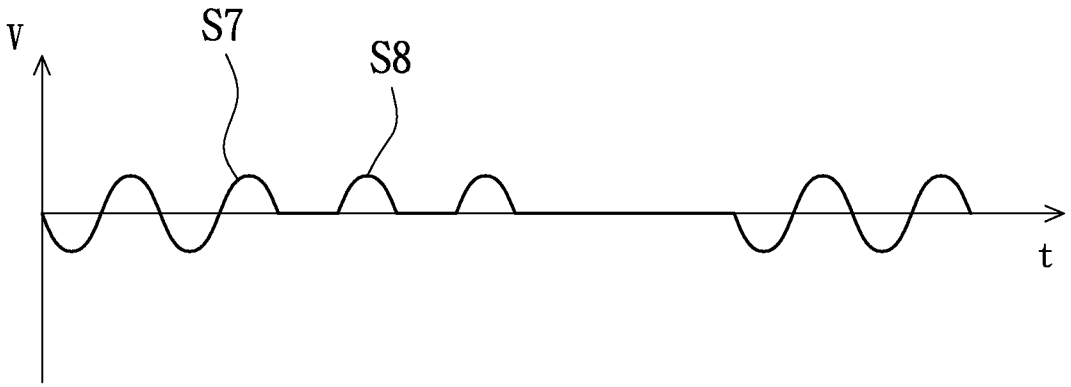
FIG. 3 is a schematic diagram of the waveform of the lamp of the present invention in a full-on state.
Figure 4:
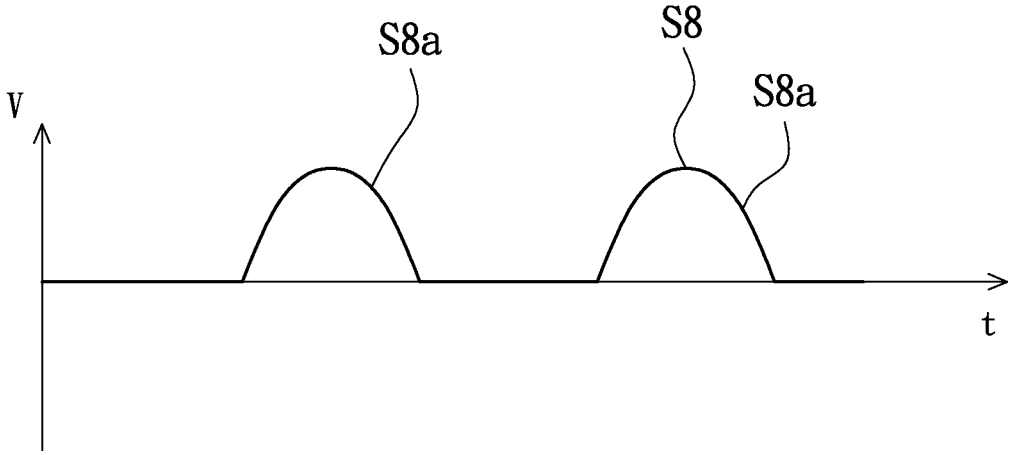
FIG. 4 is a schematic diagram of the waveform of the lamp full-on color temperature change control signal of the lamp of the present invention, showing the first positive half cycle.
Figure 5:
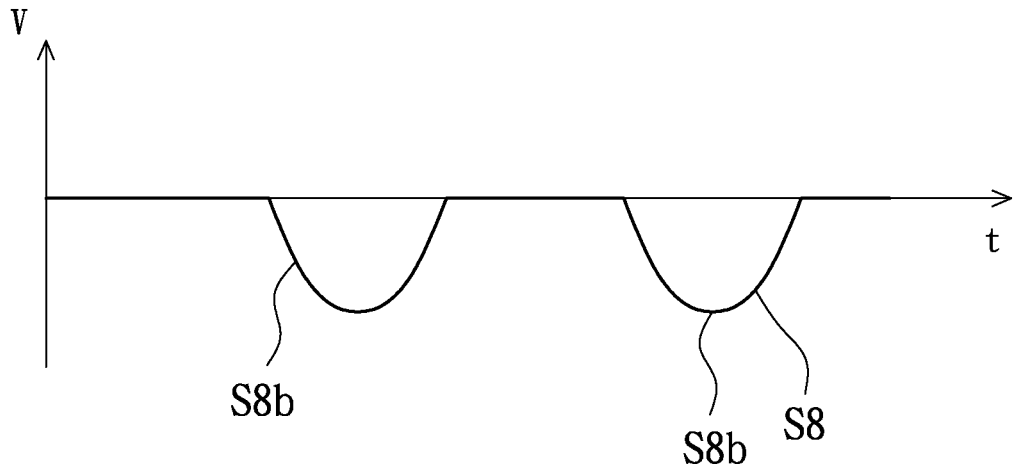
FIG. 5 is a schematic diagram of the waveform of the lamp full-on color temperature change control signal of the lamp of the present invention, showing the first negative half cycle.
Figure 6:
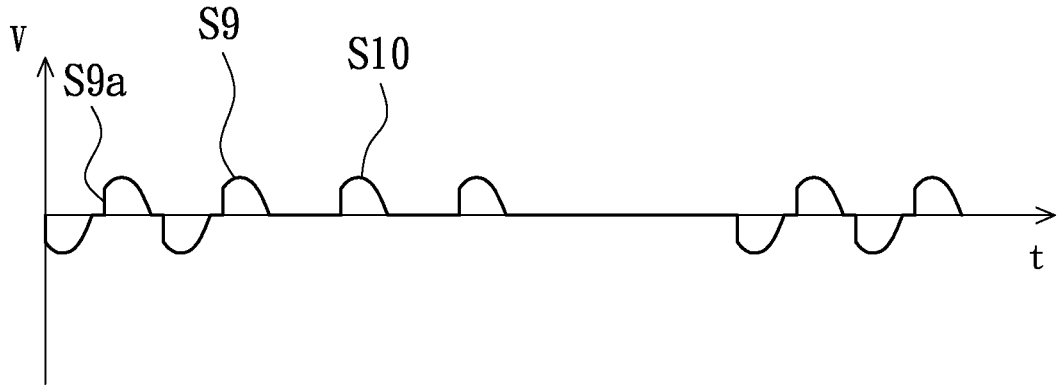
FIG. 6 is a schematic diagram of the waveform of the lamp of the present invention in a dimming state.
Figure 7:
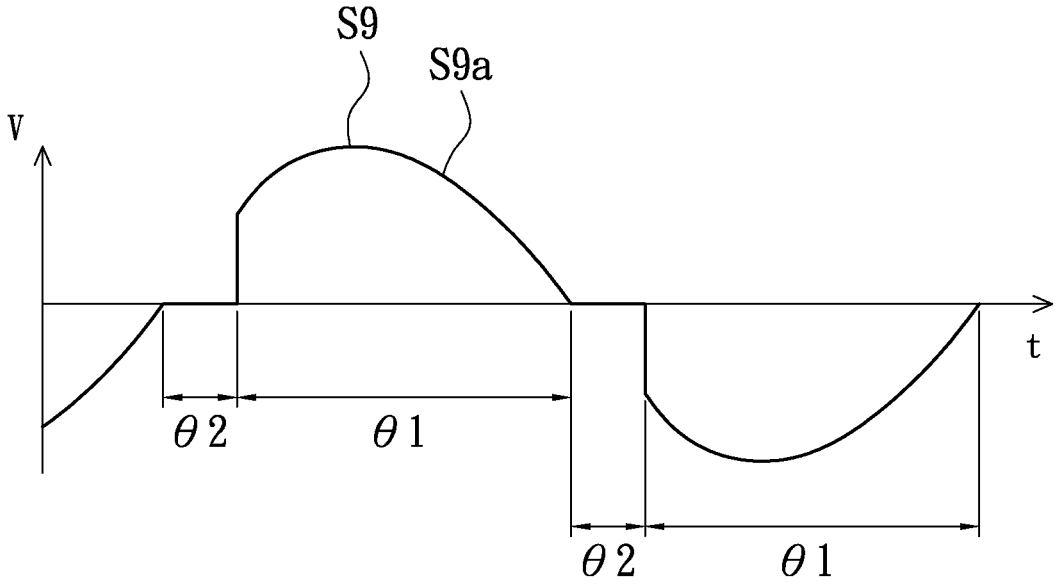
FIG. 7 is a schematic diagram of the waveform of the lamp dimming control signal of the present invention.
Figure 8:
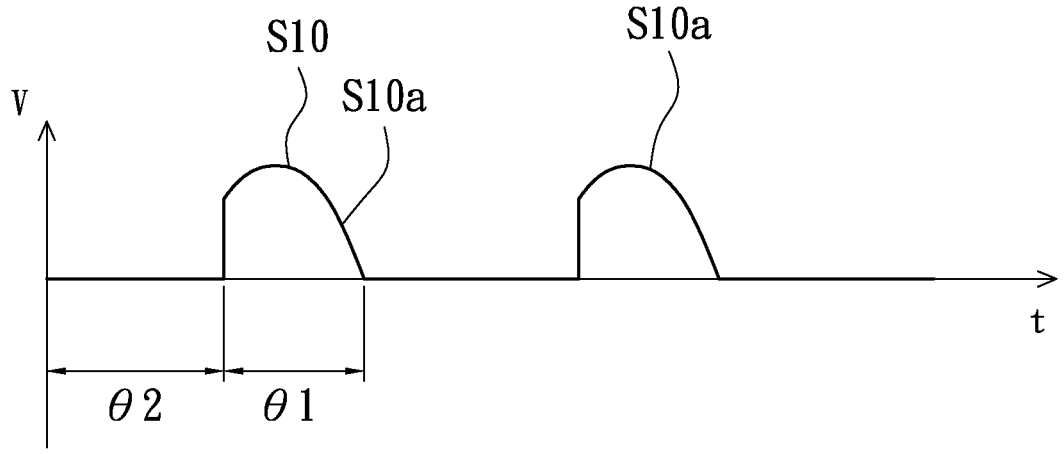
FIG. 8 is a schematic diagram of the waveform of the lamp dimming color temperature change control signal of the present invention, showing the second positive half cycle.
Figure 9:
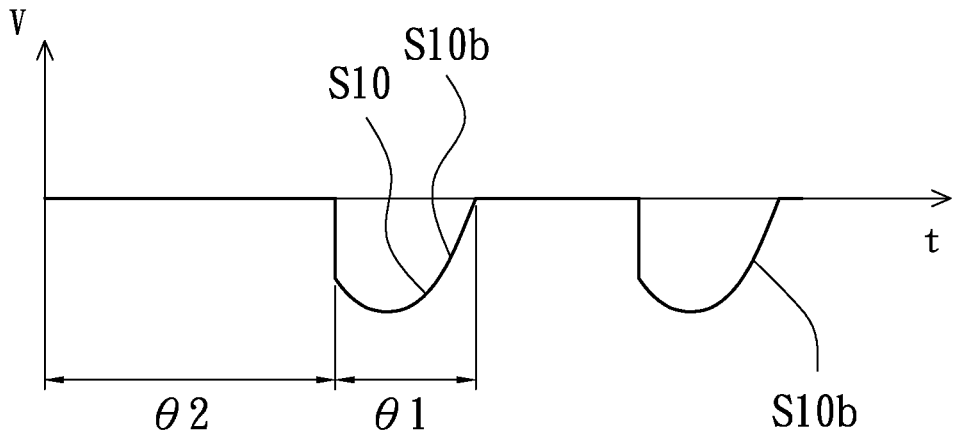
FIG. 9 is a schematic diagram of the waveform of the lamp dimming color temperature change control signal of the present invention, showing the second negative half cycle.

The power control circuit 40 includes a TRIAC 41 (triode for alternating current). The power control circuit 40 is electrically connected to the processor 30 and the mains electricity source 210. The power control circuit 40 can output a lamp full-on control signal S7 to the driver 220 according to the received AC power source and the lamp full-on processing signal S4 for controlling the lamp 200 to be in a full-on state. The voltage-time waveform of the lamp full-on control signal S7 is periodic sine waves composed of multiple cycles of sine waves. As shown in FIG. 3, the power control circuit 40 can output a lamp full-on color temperature change control signal S8 to the driver 220 according to the full-on state of the lamp 200 and the color temperature change processing signal S6 for controlling the lamp 200 to change the color temperature in the full-on state. The duration (pulse width) of the lamp full-on color temperature change control signal S8 is at least more than 20 ms. The voltage-time waveform of the lamp full-on color temperature change control signal S8 may be composed of a plurality of spaced first positive half cycles S8*a*, as shown in FIG. 4, or may be composed of a plurality of spaced first negative half cycles S8*b*, as shown in FIG. 5. Each first positive half cycle S8*a* is the positive half cycle of the sine wave. Each first negative half cycle S8*b* is the negative half cycle of the sine wave. The power control circuit 40 can output a lamp dimming control signal S9 to the driver 220 to reduce the brightness of the lamp 200 according to the received AC power source and the lamp dimming processing signal S5 for the lamp 200 to be in a dimming state. The voltage-time waveform of the lamp dimming control signal S9 is a periodic dimming wave S9*a* composed of a plurality of cycles of dimming waves S9*a*. The dimming wave S9*a* of each cycle is composed of a positive half cycle and a negative half cycle of the sine wave. The positive half cycle and the negative half cycle each have a conduction angle θ1 and a triggering angle θ2. The triggering angle is also called a firing angle or a delay angle. As shown in FIG. 6 and FIG. 7, the power control circuit 40 can output a lamp dimming color temperature change control signal S10 to the driver 220 according to the dimming state of the lamp 200 and the color temperature change processing signal S6 for controlling the lamp 200 to change the color temperature in the dimming state. The duration (pulse width) of the lamp dimming color temperature change control signal S10 is at least more than 20 ms. The voltage-time waveform of the lamp dimming color temperature change control signal S10 may be composed of a plurality of spaced second positive half cycles S10*a*, as shown in FIG. 8, or may be composed of a plurality of spaced second negative half cycles S10*b*, as shown in FIG. 9. Each second positive half cycle S10*a* is formed by the positive half cycle of the sine wave with a conduction angle θ1 and a triggering angle θ2. The sum of the conduction angle θ1 and the triggering angle θ2 of each second positive half cycle S10*a* is 180 degrees. The conduction angle θ1 is not more than 179 degrees. Each second negative half cycle S10*b* is formed by the negative half cycle of the sine wave with a conduction angle θ1 and a triggering angle θ2. The sum of the conduction angle θ1 and the triggering angle θ2 of each second negative half cycle S10*b* is 180 degrees. The conduction angle θ1 is not more than 179 degrees.

The lamp 200 can change the color temperature in the lamp full-on state. The power control circuit 40 can output the lamp full-on color temperature change control signal S8 to the driver 220 according to the full-on state of the lamp 200 and the color temperature change processing signal S6 for controlling the lamp 200 to change the color temperature in the full-on state. The duration (pulse width) of the lamp full-on color temperature change control signal S8 is at least more than 20 ms. The voltage-time waveform of the lamp full-on color temperature change control signal S8 may be composed of a plurality of spaced first positive half cycles S8*a*, as shown in FIG. 4, or may be composed of a plurality of spaced first negative half cycles S8*b*, as shown in FIG. 5. Each first positive half cycle S8*a* is the positive half cycle of the sine wave. Each first negative half cycle S8*b* is the negative half cycle of the sine wave.

In addition, the lamp 200 can also change the color temperature in the dimming state. The power control circuit 40 can output the lamp dimming color temperature change control signal S10 to the driver 220 according to the dimming state of the lamp 200 and the color temperature change processing signal S6 for controlling the lamp 200 to change the color temperature in the dimming state. The duration (pulse width) of the lamp dimming color temperature change control signal S10 is at least more than 20 ms. The voltage-time waveform of the lamp dimming color temperature change control signal S10 may be composed of a plurality of spaced second positive half cycles S10*a*, as shown in FIG. 8, or may be composed of a plurality of spaced second negative half cycles S10*b*, as shown in FIG. 9. Thereby, the present invention can change the color temperature in the full-on state of the lamp or in the dimming state of the lamp, thereby increasing the convenience of use.

The duration (pulse width) of each of the lamp full-on color temperature change control signal S8 and the lamp dimming color temperature change control signal S10 is at least more than 20 ms. After the driver 220 receives the lamp full-on color temperature change control signal S8 and the lamp dimming color temperature change control signal S10, the lamp 200 is turned off, so that the lamp 200 is completely turned off for at least more than 20 ms. After the lamp 200 is restarted, the lamp 200 is controlled to change the color temperature.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A color temperature control device for an LED lamp, electrically connected to a lamp and a mains electricity source, the mains electricity source outputting an AC power source, the lamp being an LED lamp, the lamp including a driver, the color temperature control device comprising:

a power supply, electrically connected to the mains electricity source, the power supply being configured to output a DC power source;

at least one operating device, the operating device being controlled to output a lamp full-on operation signal and a color temperature change operation signal, wherein the operating device is one of a wireless remote control receiver, a wall-mounted switch and a hand-pulling switch;

a processor, the processor being an MCU processor, the processor being electrically connected to the power supply to receive the DC power source for operation of the processor, the processor being electrically connected to the operating device, the processor receiving the lamp full-on operation signal to output a lamp full-on processing signal, the processor receiving the color temperature change operation signal to output a color temperature change processing signal; and a power control circuit, the power control circuit being electrically connected to the processor and the mains electricity source, the power control circuit outputting a lamp full-on control signal to the driver according to the received AC power source and the lamp full-on processing signal for controlling the lamp to be in a full-on state, a voltage-time waveform of the lamp full-on control signal being periodic sine waves composed of multiple cycles of sine waves, the power control circuit outputting a lamp full-on color temperature change control signal to the driver according to the full-on state of the lamp and the color temperature change processing signal for controlling the lamp to change its color temperature in the full-on state, a voltage-time waveform of the lamp full-on color temperature change control signal being composed of a plurality of spaced first positive half cycles or a plurality of spaced first negative half cycles, each first positive half cycle being a positive half cycle of the sine wave, each first negative half cycle being a negative half cycle of the sine wave, wherein the operating device outputs a lamp dimming operation signal, the processor receives the lamp dimming operation signal to output a lamp dimming processing signal, the power control circuit outputs a lamp dimming control signal to the driver according to the received AC power source and the lamp dimming processing signal for the lamp to be in a dimming state, a voltage-time waveform of the lamp dimming control signal is a periodic dimming wave composed of a plurality of cycles of dimming waves, the dimming wave of each cycle is composed of a positive half cycle and a negative half cycle of the sine wave, the positive half cycle and the negative half cycle each have a conduction angle and a triggering angle, the power control circuit outputs a lamp dimming color temperature change control signal to the driver according to the dimming state of the lamp and the color temperature change processing signal for controlling the lamp to change the color temperature in the dimming state, a voltage-time waveform of the lamp dimming color temperature change control signal is composed of a plurality of spaced second positive half cycles or a plurality of spaced second negative half cycles, each second positive half cycle is formed by the positive half cycle of the sine wave with a conduction angle and a triggering angle, and each second negative half cycle is formed by the negative half cycle of the sine wave with a conduction angle and a triggering angle.

2. The color temperature control device as claimed in claim 1, wherein the sum of the conduction angle and the triggering angle of each second positive half cycle is 180 degrees, the sum of the conduction angle and the triggering angle of each second negative half cycle is 180 degrees, and the conduction angle is not more than 179 degrees.

3. The color temperature control device as claimed in claim 1, wherein the lamp has a plurality of LED assemblies, the LED assemblies have different color temperatures, the LED assemblies each have a plurality of LED light-emitting members, and the driver controls the LED assemblies to be turned on/off for changing the color temperature of the lamp.

4. The color temperature control device as claimed in claim 3, wherein the lamp further has three LED assemblies, defined as a first LED assembly, a second LED assembly and a third LED assembly, the first LED assembly is a 5000K color temperature LED lamp, the second LED assembly is a 3000K color temperature LED lamp, and the third LED assembly is a 4000K color temperature LED lamp.

5. The color temperature control device as claimed in claim 1, wherein a duration (pulse width) of each of the lamp full-on color temperature change control signal and the lamp dimming color temperature change control signal is at least more than 20 ms.

6. The color temperature control device as claimed in claim 1, wherein after the driver receives the lamp full-on color temperature change control signal and the lamp dimming color temperature change control signal, the lamp is turned off, so that the lamp is completely turned off for at least more than 20 ms, after the lamp 200 is restarted, the lamp is controlled to change the color temperature.

7. The color temperature control device as claimed in claim 1, wherein the power control circuit includes a TRIAC.

* * * * *